US006279524B1

(12) United States Patent
Schebitz

(10) Patent No.: US 6,279,524 B1
(45) Date of Patent: Aug. 28, 2001

(54) ELECTROMAGNETIC ACTUATOR HAVING A PNEUMATIC DAMPENING ELEMENT

(75) Inventor: Michael Schebitz, Eschweiler (DE)

(73) Assignee: FEV Motorentechnik GmbH, Aachen (DE)

( * ) Notice: Subject to any disclaimer, the term of this patent is extended or adjusted under 35 U.S.C. 154(b) by 0 days.

(21) Appl. No.: 09/501,144

(22) Filed: Feb. 9, 2000

(30) Foreign Application Priority Data

Feb. 9, 1999 (DE) ..... 199 05 176

(51) Int. Cl.[7] ..... F01L 9/04; H01F 7/08

(52) U.S. Cl. ..... 123/90.11; 123/90.65; 251/129.01; 251/129.16; 335/257; 335/277

(58) Field of Search ..... 123/90.11, 90.14, 123/90.65; 251/129.01, 129.09, 129.1, 129.15, 129.16; 335/256, 257, 266, 268, 277

(56) References Cited

U.S. PATENT DOCUMENTS 4,515,343 * 5/1985 Pischinger et al. ..... 251/48
4,867,111 * 9/1989 Schneider et al. ..... 123/90.11
5,223,812 * 6/1993 Kreuter ..... 335/256
5,943,988 * 8/1999 Burger et al. ..... 123/90.11

* cited by examiner

*Primary Examiner*—Weilun Lo
(74) *Attorney, Agent, or Firm*—Venable; Gabor J. Kelemen

(57) ABSTRACT

An electromagnetic actuator for operating a driven member includes an electromagnet having a yoke provided with a pole face and a coil supported by the yoke and adapted to be supplied with electric current to produce an electromagnetic force; and an armature connectable to the driven member and movable in a path of motion into a first position and a second position spaced from the first position. The armature is moved by the electromagnetic forces into the second position in contact with the pole face. A resetting spring is coupled to the armature and exerts a spring force thereon for urging the armature away from the second position toward the first position. The actuator further includes a dampening assembly which has a piston affixed to the armature and a dampening cylinder provided in the yoke and having an open end oriented toward the armature and being in an axial alignment with the piston. In the first position of the armature the piston is axially spaced from the dampening cylinder. The piston enters the dampening cylinder solely during a terminal portion of the path of motion of the armature during displacement thereof toward the second position.

6 Claims, 2 Drawing Sheets

ELECTROMAGNETIC ACTUATOR HAVING A PNEUMATIC DAMPENING ELEMENT

CROSS REFERENCE TO RELATED APPLICATION

This application claims the priority of German Application No. 199 05 176.3 filed Feb. 9, 1999, which is incorporated herein by reference.

BACKGROUND OF THE INVENTION

In an electromagnetic actuator for operating a driven member at least one electromagnet is provided which has a yoke body and with which a back-and-forth movable armature plate is associated. When the electromagnet is energized, the armature plate is moved against the force of a resetting spring from a first switching position into a second switching position in which the armature plate engages the pole face of the yoke body. If the electromagnet is de-energized, the armature plate is returned to its first switching position under the effect of the resetting force of the resetting spring.

For certain applications, for example, for operating an engine valve of a piston-type internal-combustion engine where the engine valve constitutes the driven member, two spaced electromagnets are provided whose pole faces are oriented towards one another and between which the armature plate, attached to a guide bar, is movable back and forth against the force of resetting springs. When the electromagnets are de-energized, the armature plate assumes a mid position between the two electromagnets. If the electromagnets are alternatingly energized, the armature plate moves from a first switching position which is defined by its engagement with the pole face of one electromagnet, into its second switching position after de-energization of the last-named, momentarily holding electromagnet and energization of the other, momentarily capturing electromagnet. The second switching position of the armature plate is defined by its engagement with the pole face of the other, capturing electromagnet. By means of a suitable control of current supply in an alternating manner, the armature plate and thus the driven member may again be moved into the first switching position.

In the earlier-noted mode of application for operating an engine valve in a piston engine not only a high switching frequency is obtained but, based on the relatively large stroke of the engine valve, the armature has an oscillating path (stroke) of significant length. Despite the resetting force of the resetting spring arranged at the capturing electromagnet and acting on the armature plate during its approach to the pole face of the capturing electromagnet, the net attracting force on the armature plate increases exponentially, since, as the distance between the armature plate and the pole face of the capturing electromagnet decreases, the electromagnetic force increases exponentially, while the opposing spring force increases only linearly. As a result, the armature plate is increasingly accelerated until it impacts on the pole face of the capturing electromagnet. The resulting high impact velocity leads to a significant noise generation and may also lead to disadvantageous rebounding phenomena.

Conventional pneumatic dampening arrangements for braking the armature, such as disclosed, for example, in published European Patent Application 0 870 906, not only require a significant structural height; also, they are not capable of delivering the required dampening force with acceptable frictional values.

By means of controlling the current supply of the momentary capturing electromagnet, it is feasible to change the magnetic force during the approaching phase of the armature plate in such a manner that the armature plate arrives into contact with the pole face with a reduced speed. It is, to be sure, in principle possible to change, by controlling the current supply of the capturing electromagnet, the magnetic force in such a manner that the armature plate arrives with a "zero" impact velocity in contact with the pole face of the capturing electromagnet. Because of stochastic oscillations in the system, however, a reliable, secure capturing and holding of the armature plate is not feasible. Thus, for reasons of operational reliability the current supply of the capturing electromagnet must be set in such a manner that the armature plate arrives in contact with the pole face with a reduced, but significant residual speed. While rebound phenomena are in this manner prevented, noise generation nevertheless persists. By means of the above-described reduction of the impact velocity, however, significantly reduced dampening forces are required.

SUMMARY OF THE INVENTION

It is an object of the invention to provide an improved electromagnetic actuator which has a pneumatic dampening element of compact construction.

This object and others to become apparent as the specification progresses, are accomplished by the invention, according to which, briefly stated, the electromagnetic actuator for operating a driven member includes an electromagnet having a yoke provided with a pole face and a coil supported by the yoke and adapted to be supplied with electric current to produce an electromagnetic force; and an armature connectable to the driven member and movable in a path of motion into a first position and a second position spaced from the first position. The armature is moved by the electromagnetic forces into the second position in contact with the pole face. A resetting spring is coupled to the armature and exerts a spring force thereon for urging the armature away from the second position toward the first position. The actuator further includes a dampening assembly which has a piston affixed to the armature and a dampening cylinder provided in the yoke and having an open end oriented toward the armature and being in an axial alignment with the piston. In the first position of the armature the piston is axially spaced from the dampening cylinder. The piston enters the dampening cylinder solely during a terminal portion of the path of motion of the armature during displacement thereof toward the second position.

Since in case of a suitable control of the current supply of the capturing electromagnet the impact velocity is reduced, a very compact dampening element may be provided which may be integrated directly into the electromagnetic actuator without adversely affecting the course of the magnetic field lines of the electromagnet. It is a further advantage of the invention that such a dampening element may be utilized in armature plates with different circumferential contour without changing the construction; that is, the same dampening element may be used for an armature plate whether its contour is, for example, circular or polygonal.

According to an advantageous feature of the invention, the armature plate is coupled with a guide bar which, in turn, is guided in a bore of the yoke body and further, the dampening cylinder is arranged in the region of the bore and surrounds the guide bar. Such an arrangement has the advantage that the dampening element is situated in the region of the pole face of the yoke body in which the course of the field lines is, in any event, distorted by the preferably non-magnetic guide bar so that an arrangement of the dampening cylinder in the pole face, on the one hand, and the associated dampening piston on the face of the armature plate, on the other hand, does not lead to additionally disturbing the magnetic flux. The piston body is formed by an annular collar surrounding the guide bar in the zone of the plane of the armature plate. Expediently, the terminal peripheral edge of the dampening piston oriented towards the dampening cylinder is rounded. As a result, the dampening force exerted by the air in the annular chamber of the dampening cylinder on the dampening piston does not increase abruptly as the dampening piston enters the dampening cylinder; rather, by virtue of the rounded piston edge the pressure increases progressively because of the progressively narrowing air gap.

According to a further advantageous feature of the invention, the dampening cylinder is arranged in a cavity of the yoke body. Such a cavity may be, for example, an enlargement of the guide bore for the guide bar. The enlargement is dimensioned dependent on the size of the dampening cylinder.

Since usually the yoke of such an electromagnet is formed of a lamina stack made of thin sheet metal plates, and thus the yoke cavity itself cannot be directly used as a cylinder, according to an advantageous feature of the invention, the dampening cylinder is formed by an annular body made of a plastic material, expediently polytetrafluoroethylene. It is further expedient to arrange the annular body with a radial clearance in the cavity of the yoke. As a result, in conjunction with a rounded edge of the dampening piston an automatic centering of the dampening cylinder is obtained. Such an automatic centering compensates not only for manufacturing inaccuracies but also for a changing clearance between the guide bar and the guide in the yoke. It is an advantage of using a plastic material, particularly PTFE for the dampening cylinder, in conjunction with the small radial clearance for the annular body forming the dampening cylinder, that a low-friction dampening element is obtained. Thus, the delay at the beginning of the armature motion upon de-energization of the holding electromagnet is practically not affected by the frictional forces generated between the dampening piston and the wall of the dampening cylinder. By virtue of the small radial clearance of the annular body in the socket of the yoke and also by virtue of the minimal annular clearance between the guiding component for the guide bar on the one hand and the guide bar itself on the other hand, the dampening cylinder has a minimal leakage space. Consequently, during the last phase of the penetration of the dampening piston into the dampening cylinder no reverse spring effect can appear; rather, the air present in the progressively diminishing cylinder chamber may escape in a throttled manner.

According to a further advantageous feature of the invention the annular body is in contact with an elastic intermediate layer which, however thin, reduces the sound transmission in the device.

According to a further advantageous feature of the invention a guide sleeve is arranged in the yoke for guiding the guide bar. Further, that end of the guide sleeve which is oriented towards the pole face is formed as a socket for the dampening cylinder. By virtue of such a construction, the dampening cylinder which, in any event, has very small dimensions, may be integrated in the guide sleeve whereby a compact, easily installable structural component is obtained. Also, no angular deviations from the alignment between the axis of the dampening cylinder and the axis of the guide sleeve can occur.

DESCRIPTION OF THE PREFERRED EMBODIMENT

Figure 1:
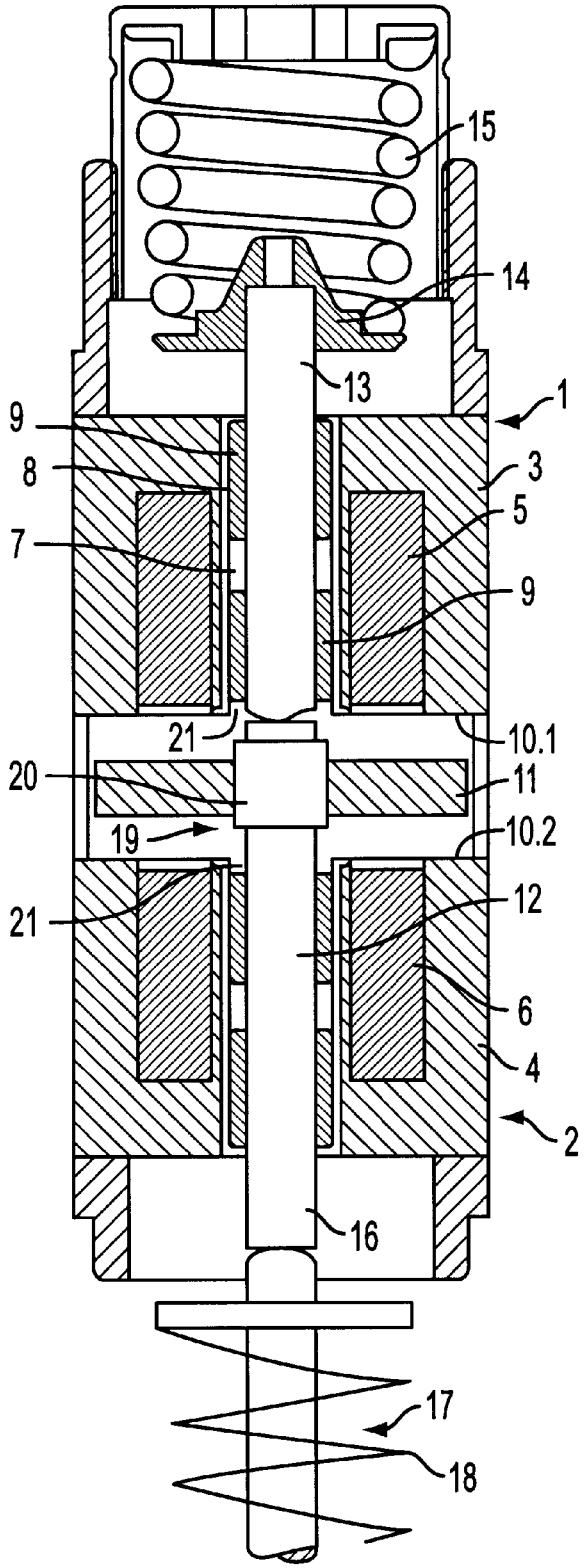
FIG. 1 is an axial sectional view of an electromagnetic actuator incorporating the invention.

The electromagnetic actuator illustrated in FIG. 1 is composed essentially of two electromagnets 1 and 2 each having a respective laminated yoke 3 and 4 in which respective coils 5 and 6 are arranged. The coils 5 and 6 are coupled to a non-illustrated controllable current supply.

The yokes 3 and 4 each have a bore 7 in which a respective guide sleeve 8 is secured, for example, by gluing. In each guide sleeve 8 one or two glide sleeves 9, made, for example, by a self-lubricating sintered body, are secured by press fit.

The respective pole faces 10.1, 10.2 of the two spaced electromagnets 1 and 2 are oriented toward one another. In the space between the pole faces 10.1, 10.2 of the two electromagnets 1 and 2 a plate-shaped armature 11 is arranged which is fixedly connected with a guide bar 12 which, in turn, is guided in the guide sleeve 8 of the electromagnet 2. In the electromagnet 1 a separate guide bar 13 is arranged which is supported at one end on the guide bar 12 and, at its other end, on a resetting spring 15 with the intermediary of a spring seat disk 14.

The free end 16 of the guide bar 12 contacts an end of a driven member 17, for example, the stem of an engine valve with which a resetting spring 18 is associated. Both resetting springs 15 and 18 are so designed that in case the electromagnets 1 and 2 are in a de-energized state, the armature 11 assumes a position in the middle between the two pole faces 10.1, 10.2.

The two electromagnets 1 and 2 are supplied alternatingly with current from a controlled current supply, causing the armature 11 to alternatingly travel to the pole face 10.1 of the electromagnet 1 and the pole face 10.2 of the electromagnet 2. Further, upon energizing the solenoid 5 or 6 with a holding current the armature 11 is maintained at the respective pole face 10.1, 10.2 for a predetermined period.

Thus, in each instance during the approach of the armature 11 to the pole face of the energized, that is, the capturing electromagnet, the magnetic force affecting the armature 11, in case of a non-regulated current supply, exponentially increases, while the force of the associated resetting spring increases only linearly. Thus, the armature 11 is moved towards the respective pole face 10.1 or 10.2 with increasing speed so that it impacts on the pole face with a relatively high speed. By a suitable reduction of the current supply to the coil of the capturing electromagnet, as the armature 11 approaches the pole face, the magnetic force exerted on the armature 11 is reduced in such a manner that by the moment the armature contacts the pole face, the magnetic force only slightly exceeds the respective resetting force of the associated resetting spring. As a result, the armature 11 arrives into contact with the pole face with a reduced speed.

To further reduce the armature impact on the respective pole face 10.1 or 10.2, according to the invention a dampening assembly 19 is provided which is essentially composed of a piston 20 affixed to the guide bar 16 and respective dampening cylinders 21 provided in the respective yokes 3 and 4. The piston 20 enters into the respective dampening cylinder 21 shortly before the armature 11 arrives into contact with the respective pole face 10.1 or 10.2. The air cushion present during the introduction of the piston 20 into the respective cylinder 21 may be caused to decay by a throttle gap defined between the circumference of the piston 20 and the guide bar 7 on one hand and the inner face of the glide sleeve 9 on the other hand, whereby the armature 11 arrives softly into contact with the respective pole face 10.1 or 10.2.

Figure 2:
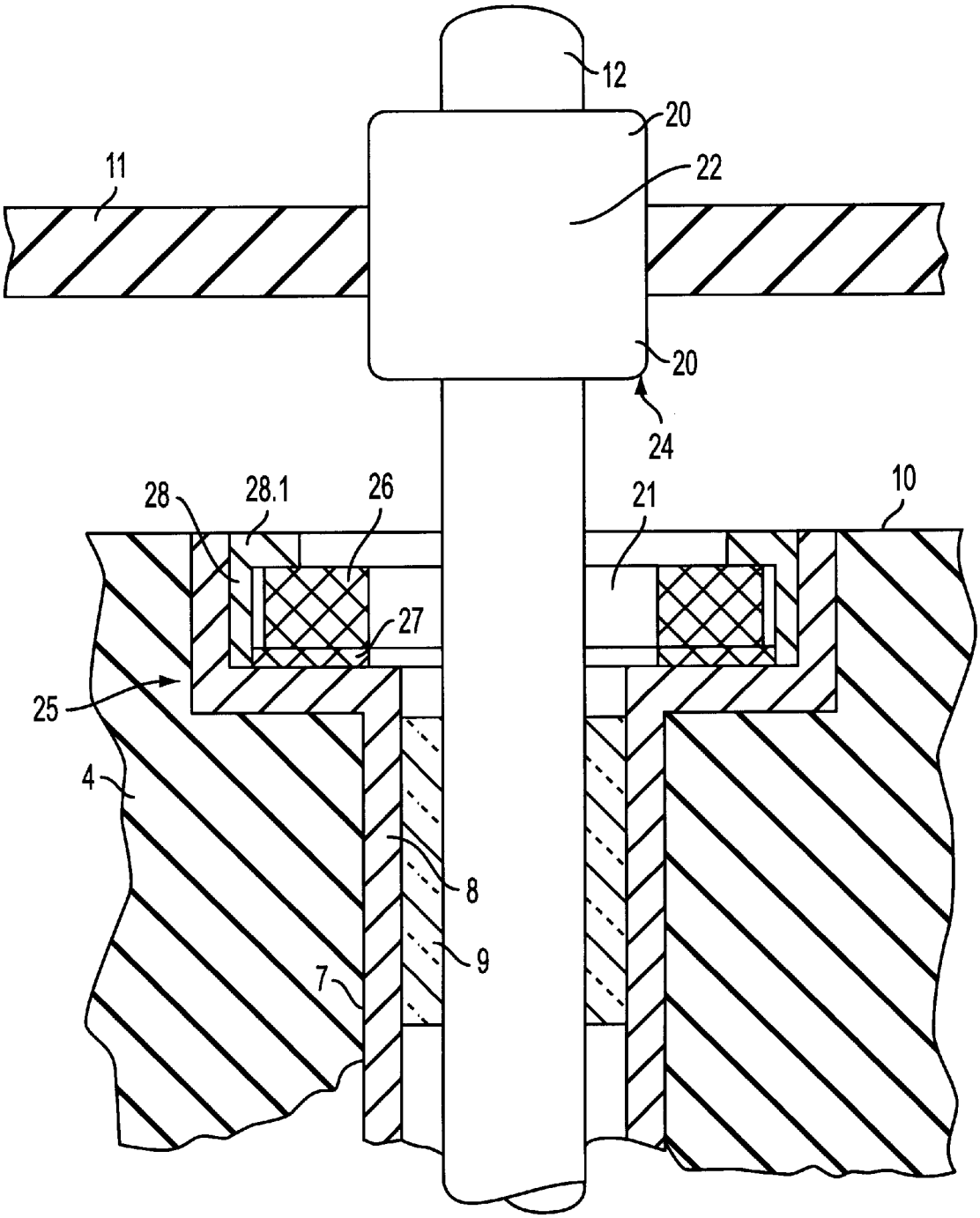
FIG. 2 is an enlarged axial sectional detail of the construction shown in FIG. 1.

FIG. 2 illustrates an embodiment of the dampening assembly 19 in greater detail. In the region of its connection with the armature 11 the guide bar 12 has a collar 22 of a greater diameter than that of the guide bar 12 proper. The collar 22 is so structured that it axially projects beyond the armature 11 on both sides and forms the dampening piston 20. The peripheral edge 24 at both ends of the dampening piston 20 is rounded.

The upper end of the guide sleeve 8 provided, for example, in the yoke 4 of the electromagnet 2 is provided with a socket 25 in which a ring 26 is inserted. The ring 26 is made of a wear-resistant plastic material having a low surface friction, such as PTFE. The ring 26 is seated on the bottom of the socket with the interposition of a thin elastic intermediate layer 27. The ring 26 is immobilized in the socket 25 by an annular securing member 28 having a radially inwardly extending rim 28.1. The inner diameter of the ring 26 is only slightly greater than the outer diameter of the dampening piston 20 and thus constitutes the dampening cylinder 21. The ring 26 is supported in the socket 25 by the securing member 28 in such a manner that the ring 26 has a slight radial play. Thus, the dampening cylinder 21 formed by the ring 26 may be self-centered relative to the dampening piston 20.

As the dampening piston 20 enters the dampening cylinder 21, first an open annular clearance is obtained because of the rounding of the edge 24. The clearance narrows as the dampening piston 20 further penetrates into the dampening cylinder 21 until the cylindrical outer wall of the dampening piston 20 and the cylindrical wall of the dampening cylinder 21 arrive in a practically direct contact with one another. The clearance between the dampening piston 20 and the dampening cylinder 21 is so designed that the dampening piston 20 is moved along the wall of the dampening cylinder 21 with minimal friction.

As soon as the dampening piston 20 has penetrated into the dampening cylinder 21, in the closed cylinder chamber first an air cushion is obtained which, however, due to the minimal leakage present, for example, between the sleeve 9 and the guide bar 12, decays so that the armature 11 eventually arrives into contact with the pole face of the yoke body.

It is to be understood that the invention is not limited to the illustrated and described embodiment of an actuator having two electromagnets. Rather, the invention may find application in actuators which have a sole electromagnet and in which the armature 11 is maintained by a resetting spring in a first switching position in the deenergized state of the electromagnet and upon energizing the electromagnet it moves in the direction of the pole face of the electromagnet against the force of the resetting spring and after contacting the pole face, the armature is maintained in its defined second switching position as long as the electromagnet is in an energized state.

By way of an example of dimensions, in case of a diameter of the piston 20 of, for example, 10 mm, the piston 20 projects beyond the related surface of the armature 11 by approximately 3 mm. The inner diameter of the dampening cylinder 21 defined by the ring 26 is slightly greater than the diameter of the piston body 20 and has, for example, an outer diameter of approximately 14 mm. In case of a total depth of approximately 3 mm, the ring 26 has a thickness of approximately 1.6 mm so that for the intermediate layer 27 an elastic material having only a thickness of 0.4 mm may be provided. The elastic intermediate layer 27 is, for example, of NBR having a hardness of 70 shore. The thickness of the retaining rim 28.1 of the securing member 28 extending over the ring 26 has then a thickness of, for example, 1 mm. These dimensional relationships result in a small overall structural volume of the dampening assembly 19 according to the invention.

It will be understood that the above description of the present invention is susceptible to various modifications, changes and adaptations, and the same are intended to be comprehended within the meaning and range of equivalents of the appended claims.

What is claimed is:

1. An electromagnetic actuator for operating a driven member, comprising (a) an electromagnet having
  (1) a yoke provided with a pole face and a passage; and
  (2) a coil supported by said yoke and adapted to be supplied with electric current to produce an electromagnetic force;

(b) an armature connectable to the driven member and movable in a path of motion into a first position and a second position spaced from said first position; said armature being moved by the electromagnetic forces into said second position in contact with said pole face;

(c) a resetting spring coupled to said armature and exerting a spring force thereon for urging said armature away from said second position toward said first position;

(d) a dampening assembly including
  (1) a piston affixed to said armature; and
  (2) a dampening cylinder provided in said yoke and having an open end oriented toward said armature and being in an axial alignment with said piston; in said first position of said armature said piston being axially spaced from said dampening cylinder; said piston entering said dampening cylinder solely during a terminal portion of said path of motion during displacement of said armature toward said second position; said passage of said yoke being in axial alignment and in communication with said dampening cylinder;

(e) a guide bar affixed to said armature and passing through said passage; and (f) a sleeve positioned in said passage; said guide bar passing through said sleeve; said sleeve having an end portion situated at said pole face; and said end portion forming a socket accommodating said dampening cylinder.

2. The electromagnetic actuator as defined in claim 1, wherein said piston has an end oriented toward said dampening cylinder and further wherein said end of said piston has a rounded peripheral edge.

3. An electromagnetic actuator for operating a driven member, comprising (a) an electromagnet having
  (1) a yoke provided with a pole face and a socket; and
  (2) a coil supported by said yoke and adapted to be supplied with electric current to produce an electromagnetic force;

(b) an armature connectable to the driven member and movable in a path of motion into a first position and a second position spaced from said first position; said armature being moved by the electromagnetic forces into said second position in contact with said pole face;

(c) a resetting spring coupled to said armature and exerting a spring force thereon for urging said armature away from said second position toward said first position;

(d) a dampening assembly including (1) a piston affixed to said armature; and (2) a ring disposed in said socket and having an inner space constituting a dampening cylinder; said dampening cylinder having an open end oriented toward said armature and being in an axial alignment with said piston; in said first position of said armature said piston being axially spaced from said dampening cylinder; said piston entering said dampening cylinder solely during a terminal portion of said path of motion during displacement of said armature toward said second position.

4. The electromagnetic actuator as defined in claim 3, further comprising a radial clearance between said ring and said socket.

5. The electromagnetic actuator as defined in claim 3, wherein said socket has a bottom; further comprising an elastic layer positioned between said ring and said bottom.

6. The electromagnetic actuator as defined in claim 3, wherein said ring is plastic.

* * * * *